United States Patent [19]

Lalley

[11] Patent Number: 4,482,074

[45] Date of Patent: Nov. 13, 1984

[54] MULTIPURPOSE CONTAINER

[76] Inventor: Donald P. Lalley, 2017 N. 81st Pl., Scottsdale, Ariz. 85257

[21] Appl. No.: 455,656

[22] Filed: Jan. 5, 1983

[51] Int. Cl.[3] ..... B65D 6/00

[52] U.S. Cl. ..... 220/4 F; 220/6; 220/7; 229/23 R; 312/257 SM

[58] Field of Search ..... 220/4 F, 6, 7; 229/23 R, 23 BT; 312/257 SM

[56] References Cited

U.S. PATENT DOCUMENTS

| | | | |
|---|---|---|---|
| 2,942,749 | 6/1960 | Rosenberg | 220/4 F |
| 3,370,379 | 2/1968 | Gleason | 220/4 F |
| 3,410,441 | 11/1968 | Rhyne | 220/4 F |
| 3,692,204 | 9/1972 | Provi et al. | 220/4 F |

*Primary Examiner*—Joseph Man-Fu Moy

*Attorney, Agent, or Firm*—Richard R. Mybeck

[57] ABSTRACT

A multipurpose stackable container formed from a rectangular body blank having slots and/or tabs strategically defined therein and foldable to provide a hollow rectangular body having first and second top portions; and first and second header members cooperatively mountable in the respective ends of said body blank to complete said carton, each of said headers having means to secure said blank thereto and to prevent said blank from becoming involuntarily detached therefrom, and means to facilitate the stacking while preventing the lateral or longitudinal slippage of stacked cartons.

9 Claims, 8 Drawing Figures

MULTIPURPOSE CONTAINER

BACKGROUND OF THE INVENTION.

The present invention relates to containers and more particularly to containers especially adapted for, though not limited to, the packaging and shipping of fresh produce.

As is known, the packing and shipping of produce such as tomatoes, grapes, melons, cherries and the like calls for the use of specialized boxes of sturdy construction which can be readily assembled for use but when not in use, can be stacked, preferably flat, so as to minimize storage requirements.

A wide variety of containers have been devised for packing and shipping produce including those containers disclosed in U.S. Pat. No. 3,713,579 issued Jan. 30, 1973 to J. W. Chaffers; U.S. Pat. No. 4,245,773, issued Jan. 20, 1981 to R. H. Stollberg; U.S. Pat. No. 4,291,830, issued Sept. 29, 1981 to J. R. Sorenson; and U.S. Pat. No. 4,304,351 issued Dec. 8, 1981 to R. H. Stollberg.

Each of these prior art containers, while solving certain problems, created some new problems. Thus, there exists a real need for a produce container which can simultaneously achieve the containment and support of a quantity of fruits and vegetables; can be locked in a closed-cover state and yet be readily reopened to provide access to the contents; can be readily stacked to withstand the downward thrust of several like cartons stacked thereupon; and, while stacked, successfully avoid lateral or longitudinal slippage which otherwise could jeopardize the integrity of the stack.

A further need in the art is to provide a multi-component container which can be stored in relatively flat position and yet be quickly and easily assembled into a strong, durable and reopenable container. Such a container, in addition to the produce already enumerated, can provide a safe, and secure shipping storage container for corrosive materials, such as pool chemicals and like acids and caustic substances, and other substances which, if the container were to be crushed or misaligned, would cause damage to and spillage of the contents disposed therein. The attainment of such a container without resort to the steel or steel-reinforced plastic tubs would provide substantial savings to the several industries involved.

SUMMARY OF THE INVENTION

The present invention provides a unique and durable container comprising an integral box blank which when folded in a preselected manner provides a first top section, a first side wall, a bottom wall, a second side wall and a second top section; and which, when disposed in operative association with a first and second pre-formed header, defines a totally enclosed stackable carton having a reopenable lid; and reinforced side and bottom walls including unique locking means for securing said body blank to said headers to prevent the disengagement thereof during shipment and storage.

OBJECT OF THE INVENTION

It is an object of the present invention to obviate the previously described deficiencies of the prior art by providing a new and improved container design which comprises multiple components which are relatively inexpensive to produce, are capable of storage in a flat state, and which, when needed, can be quickly and easily assembled to provide a sturdy container capable of supporting for shipment or storage a wide variety of goods including but not limited to produce, chemicals and like materials which can be either damaged or spoiled if carton integrity is lost either during shipping or storage, whether used individually or stacked on shipping pallets.

These and still further objects as shall hereinafter appear, are fulfilled by the present invention in a remarkably unexpected fashion as will be readily discerned from a careful consideration of the following detailed description of exemplary embodiments thereof, especially when read in conjunction with the accompany drawings in which:

DESCRIPTION OF THE INVENTION

Figures 1, 2, 3, 4:
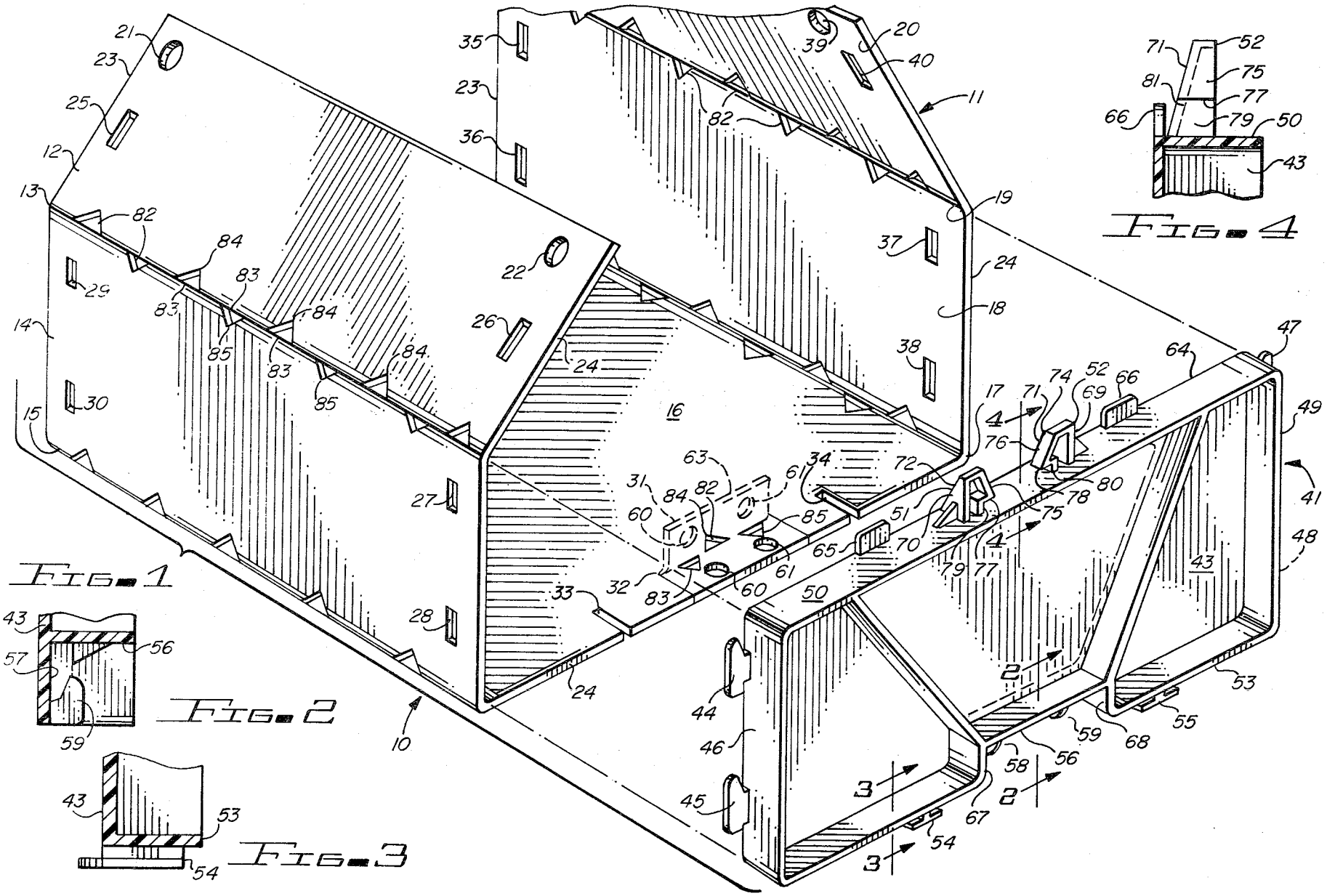
FIG. 1 is an exploded three-quarter view of a carton body blank and header embodying the present invention.
FIG. 2 is a section viewed from line 2—2 of FIG. 1.
FIG. 3 is a section viewed from line 3—3 of FIG. 1.
FIG. 4 is a section viewed from line 4—4 of FIG. 1.

Referring to FIG. 1 of the drawings, each carton 10 comprises a body portion 11 formed of corrugated cardboard, polyethylene or like material. Body portion 11 comprises a first upper section 12 joined along seam 13 with a left side portion 14 joined along seam 15 with bottom portion 16 joined along seam 17 with right side portion 18 joined along seam 19 with second upper section 20.

Upper section 12 is provided with a pair of openings 21, 22, each disposed adjacent a different body blank edge 23, 24, respectively, slightly offset from leading edge 86 and a pair of slots 25, 26 disposed in spaced registered relationship to each other in spaced trailing relationship to said openings 21, 22 in similar spaced substantially parallel relationship to edges 23, 24, respectively.

Side portion 14 is provided with a pair of openings 27, 28 disposed in vertically spaced relationship to each other in generally parallel relationship to adjacent edge 24. A second pair of openings 29, 30, are likewise positioned relative to each other and adjacent edge 23. As will hereafter appear, openings 27, 28 are disposed in substantial axial alignment with opening (slot) 26 while openings 29, 30 are disposed in substantial axial alignment with slot 25 for reasons which will hereinafter become apparent.

Bottom portion 16 is provided with a pair of rectangular tabs 31, (one hidden, 31') one disposed centrally in each of edges 23, 24, which tabs 31, 31' are foldable along seams 32, (one hidden, 32'), respectively, into an upstanding position generally normal to bottom portion 16.

Intermediate each lateral edge of tabs 31, 31' and the adjacent seam 15, 17 respectively, slots 33, 34 are cut into bottom portion 16 generally perpendicular to its associated edge, for example edge 24. Like slots (not shown) are disposed in edge 23 opposite of slots 33, 34, respectively.

Side portion 18 (identical in size and shape to side portion 14) is likewise provided with slotted openings 35, 36 adjacent and generally parallel to edge 23 and slotted openings 37, 38 adjacent and generally parallel to edge 24. When body blank 11 is disposed in its flattened condition, slots 26, 27, 28 and slots 37, 38 define a line disposed in spaced substantially parallel relationship to edge 24 whereas slots 25, 29, 30 and slots 35, 36 define a similar line substantially parallel to and spaced from edge 23.

Second upper section 20, a mirror image of section 12, is likewise provided with a pair circular openings 39 (one not visible) disposed one adjacent each of the edges 23, 24 and a pair of slots 40 (one not visible) disposed in spaced registered relationship to each other trailing said openings. While the openings and slots in section 20 are not fullyshown, the stated relationship between section 12 and section 20 renders it evident where they are positioned.

Header member 41 is disposed one within each of the end openings defined by folding the several portions of body portion 11 into a rectangular shell. Each header member 41 is identical and is interchangeable with every other.

Each header, for example, header member 41 (as shown in FIG. 1) comprises a generally rectangular integral body portion 43 having an upper and lower key member 44, 45, respectively, disposed on its left (relative to the drawing) edge 46 and upper and lower key members 47, 48, respectively disposed on its right edge 49. As will appear, keys 44, 45 are adapted for cooperative engagement in slotted openings 27, 28, respectively while keys 47, 48 cooperatively enter and engage slotted openings 37, 38, respectively.

As is shown in FIGS. 1 and 4, the upper edge 50 of header member 41 is provided with a pair of upstanding hook members 51, 52 disposed in opposed facing relationship to each other and positioned for snap-lock engagement in openings 22, 39, when header member 41 is installed in the opening defined by edge 24. Hook members 51, 52 will lock into openings 21 and the opening corresponding to opening 21 in section 20 when header 41 is installed in the opening defined by edge 23.

Remote of hook members 51, 52, on upper edge 50 adjacent the rear face 64 thereof are a pair of guide members 65, 66 which engage slotted opening 26, 40 adjacent edge 24 and slotted openings 25 and the corresponding opening in section 20 when header 41 is installed at edge 23. The coaction of guide members 65, 66 and their corresponding slots 25, 26, 40 (one not shown) will prevent the slippage of body blank 11 relative to headers 41 when carton 10 is assembled.

The interaction between hook members 51, 52 and the offset created in bottom surface 53 by central edge 56 and side walls 67, 68 needs further elaboration.

Referring first to FIGS. 1 and 4, each hook member, such as member 52, has a vertical face 69 disposed on the distal surface thereof (relative to the center of upper edge 50) so that when headers 41 are stacked one on another (usually as integral parts of finished cartons) vertical face 69 will engage the surface of side wall 68, simultaneously with the engagement of the corresponding face 70 of hook member 51 with side wall 67 while a similiar interaction occurs between the headers associated with blank edge 23 thereby substantially completely eliminating all side slippage between the stacked cartons.

Each hook member, for example member 52 (see FIG. 4) further comprises a tapered leading edge 71 which coacts with tab 31 when tab 31 is disposed in engagement with inner wall 57 of header 41, to guide juxtaposed headers into mating relationship when they are stacked. Member 51 has a similar face 72 so that when a carton 10 is stacked upon another, the beveled surfaces cooperated to firmly set the cartons and prevent the longitudinal slippage thereof.

Finally each member 51, 52 is provided with an inwardly facing surface 73, 74 respectively, which has a slanted portion 75, 76, respectively, terminating about half-way down with a lateral reach, 77, 78, respectively, extending outwardly to a vertical stem 79, 80.

When carton 10 is assembled, as will hereafter be further described, surfaces 73, 74 will cause the corresponding openings 22, 39 to be guided downwardly along and past portions 75, 76 into surface engagement with lateral reaches 77, 78 thereby securing the cover portions in a locked position.

It is of course understood that discussions specifically dealing with the interrelationship between one header 41 and body blank 11, for instance along edge 24, is equally appropriate in describing the relationship between the header 41 and the body blank 11 along edge 23 and therefore it need not be reiterated here.

Reverting back to FIGS. 1 and 3, lower edge 53, of body member 43 is provided with inverted "T" shaped members 54, 55 adapted to slip into and coact with slots 33, 34, respectively and support bottom portion 16 thereby when carton 10 is assembled.

Figure 5:
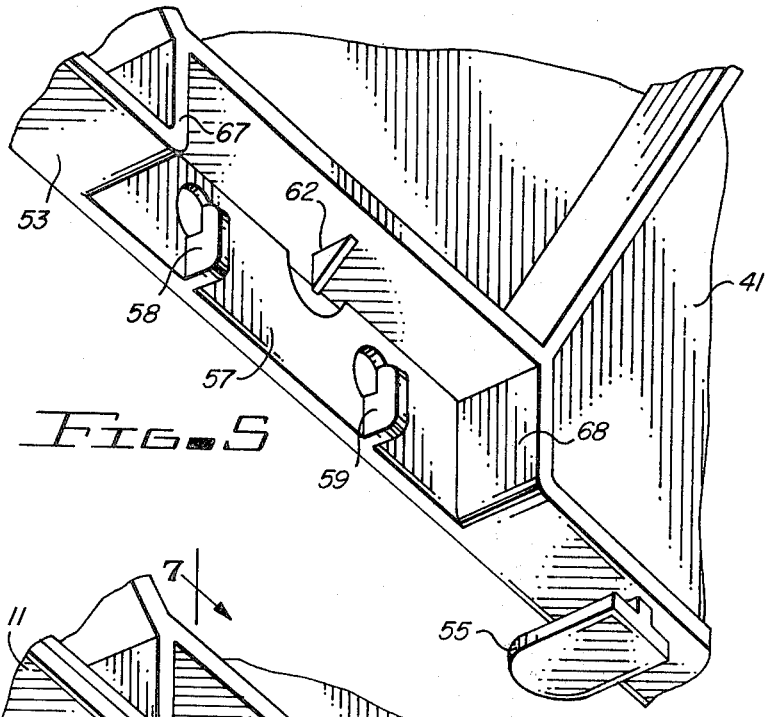
FIG. 5 is a three quarter view, partial broken away, of a header embodying the present invention.
Figure 6:
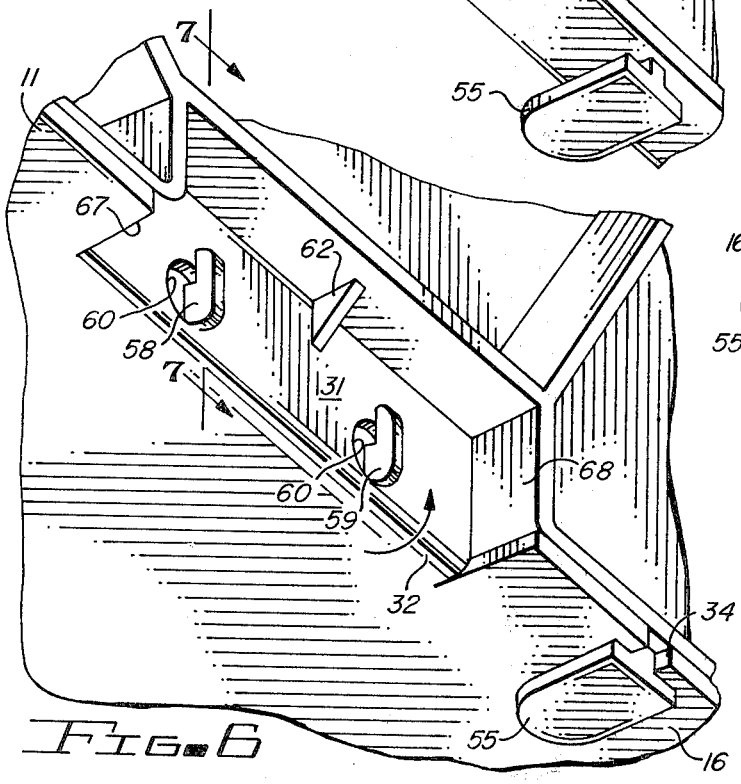
FIG. 6 is a three-quarter view of the header portion shown in FIG. 5 with the cooperative portion of the carton-blank disposed in locking engagement therewith.
Figure 7:
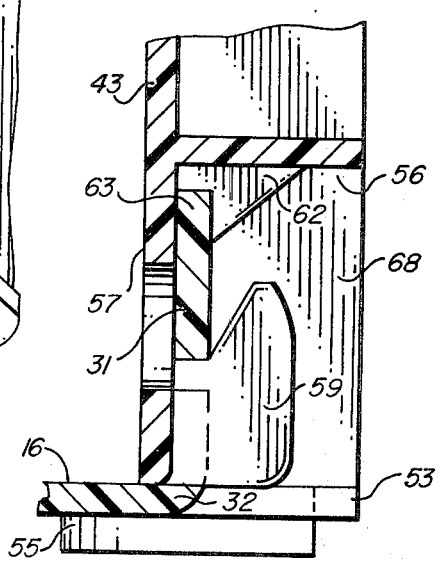
FIG. 7 is a view taken from line 7—7 of FIG. 6.

As previously described, central edge 56 is offset from lower edge 53 of the header 41 and inner wall 57 supports outreaching keys 58, 59 respectively (see FIGS. 2 and 5) adapted to engage openings 60,61 defined in tab 31. A snub 62 is adapted to engage and secure the upper edge 63 of tab 31 (see FIGS. 1, 6 and 7) when tab 31 is folded upwardly as previously described between side walls 67, 68.

To assemble the above-described embodiment of the present invention, body portion 11 is wrapped around a pair of header members 41 and the several cooperating keys and openings are engaged in the manner described to secure the structure into an integral unit. Specifically, T-shaped members 54, 55 are respectively slid into slots 33, 34 and tab 31 is folded up over inner wall 57 until keys 58, 59 penetrate openings 60, 61 and edge 63 engages snub 62 and is secured thereby. The second header is similarly installed in bottom surface 16 at edge 23. Next side portions 14, 18 are folded upwardly along seams 15, 17 respectively and slots 27, 28, 37, 38 are respectively penetrated and engaged by keys 44, 45, 47, 48 respectively (slots 29, 30, 35, 36 are similarly interconnected with the corresponding keys on the second header.

Finally, upper sections 12, 20 are respectively folded inwardly along their respective seams 13, 19 and each, for example, section 12 are brought into a closed position by entering slots 25, 26 with guide means 65 and openings 21, 22 with hook members 51.

When thus assembled, top portions 12, 20 can be independently opened and closed as desired by the simple expedient of pulling the corresponding cover section 12, 20 off of member 51, 52 (see FIGS. 1 and 4), and out of engagement with corresponding slots 26, 40.

Each hook member, for instance member 51, comprises a hooked noose 81 defined by the mating of slanted face 75 with lateral reach 77 so that when member 51 is passed through opening 22, the memory of blank 11 causes it to return to its original alignment and "lock" carton 10 in its closed position.

Figure 8:
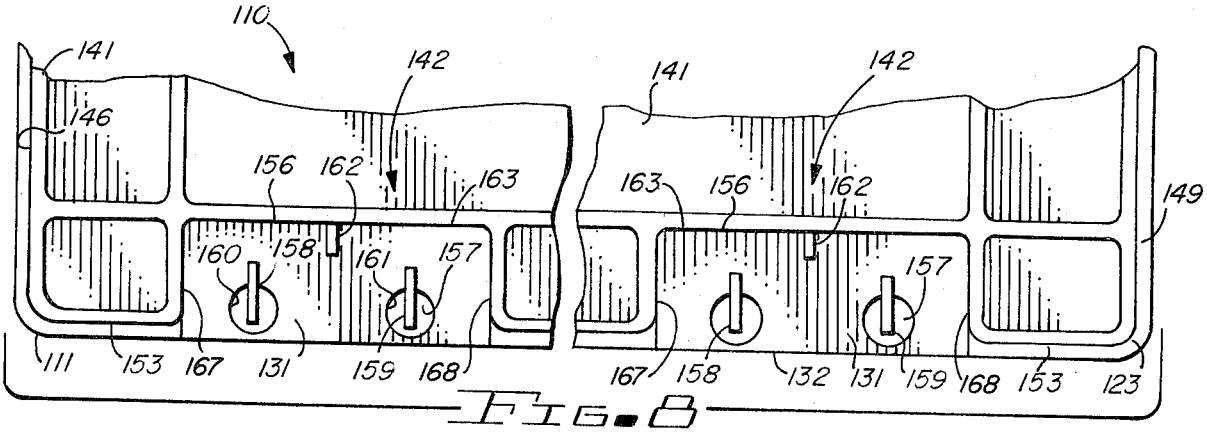
FIG. 8 is an end view of an alternative header having a plurality of locking means created in accordance with the present invention.

An alternative embodiment of the present invention is shown in FIG. 8, which for some applications may be preferred because it provides a carton having no lateral or bottom protrusions. In this embodiment, header 141 is provided with a plurality of locking means 142 which are strategically disposed on the sides and bottom thereof, for instance, a pair may be disposed on the lower edge 153 of header 141 and one or more placed on each of the side edges 146, 149. Because the description of one location will enable the artisan to clearly comprehend the placement of all such locking means 142, only one surface will be described. Referring to FIG. 8, carton 110, shown in broken view, comprises a body portion 111 having a plurality of rectangular tabs 131 defined in edge 123 thereof. A like number of tabs 131' will be disposed in corresponding relationship thereto along the far edge thereof (not shown).

Each tab 131 is prepared in the same fashion as was tab 31 in the first embodiment hereof and is foldable into generally normal relationship to body blank 111 along a seam 132.

Header 141 completes locking means 142 by presenting an inset edge 156 supported by side walls 167, 168 to lower edge 153. Edge 156 and walls 167, 168 thus frame three edges of inner wall 157. A first key 158 and a second key 159 are disposed in spaced aligned relationship to each other in inner wall 157. Keys 158, 159 are adapted to receive thereabout openings 160 and 161, respectively, defined in tab 131 when tab 131 is folded upwardly along its seam 132. Snub 162, secured to wall 157 between keys 158, 159 adjacent edge 156 engages and secures the upper edge 163 of tab 131 to complete locking means 142.

It has been found that a carton 110 having such locking means 142 disposed in the manner described provides the strong, stackable carton desired while eliminating all bottom and laterally protruding elements therefrom.

While seam 132 in only one of many mentioned herein, it should be noted that the seam line of each of the aforesaid seams, that is, seams 13, 15, 17, 19, 32, and 132 are created using the same technique, namely, the cutting or stamping of a plurality of triangular openings 82 disposed in spaced relationship to each other and having all of their respective bases 83 disposed along the desired seam line while the apexes thereof are alternated one "east" 84 and one "west" 85 along the desired line. Of course other techniques for scoring a seam line can be employed if desired although the technique herein described is preferred.

While various materials will readily occur for use in the production of the cartons herein described and illustrated, it is believed that a very economical and easily managed carton blank can be formed using extrusion grade polyethylene or like materials having a density of about 0.89 to 0.94, of course, in those applications where moisture retention is not a problem, or, indeed, may be desired, corrugated cardboard can be used for the body blank without unduly sacrificing strength. The preferred material for the header is molding grade polyethylene having a density of about 0.945 to 0.965 although a number of acceptable equivalents are available in the trade.

As is apparent, the structures herein described and illustrated provide a strong multipurpose carton which may be readily constructed and used, stacked without either lateral or longitudinal slippage, and when filled, utilizes the weight of the contents to further secure the body blank and headers into a locked position.

It is of course understood that such further alterations, modifications, and adaptations as may readily occur to the artisan confronted with this disclosure are intended within the spirit of this invention which is limited only by the scope of the claims appended hereto.

What is claimed is:

1. A multipurpose container comprising a first header member, a second header member disposed in spaced substantially parallel relationship to said first header member, each of said header members comprising a generally rectangular frame having an inner face, an outer face, an upper surface, first and second side surfaces, and a lower surface, said lower surface having a recess defined therein intermediate said first and second side surfaces, said recess having side walls and a back wall portion interconnecting said side walls, said back wall having first and second key members and a snub member attached thereto, said key members being disposed in spaced parallel relationship to each other intermediate said side walls, said snub member being disposed intermediate said key members in elevated relationship thereto; a rectangular body blank having uniform edges thereupon and a first top portion, a first side portion, a bottom portion, a second side portion and a second top portion defined therein, said contiguous portions having seam lines interposed therebetween, said blank being foldable to form a hollow rectangular body having a first and second open end; said body blank having a foldable tab defined in each of said uniform edges in registry with said recess in said adjacent header member, each said tab having an upper edge, a seam line in spaced substantially parallel relationship to said upper edge, and first and second openings defined therein, said openings being disposed respectively in registered relationship with said first and said second key member so that when said tab is folded on said seam line into substantially normal relationship to said bottom portion, each of said key members penetrates a different one of said first and second openings and said snub engages said tab adjacent said upper edge to restrain said tab from involuntarily departing from its folded position; first means for securing said first header member to said body blank in said first open end; and second means for securing said second header member to said body blank in said second open end.

2. A multipurpose container according to claim 1 in which said bottom portion has a first and second slot defined therein in spaced parallel relationship to each other, each of said slots being disposed adjacent a different seam of said bottom portion, said header member having a first and second inverter "T" shaped member depending from the lower surface thereof for sliding engagement into a corresponding one of said slots when said header member is secured into said open end of said hollow rectangular body.

3. A multipurpose container according to claim 1 having a plurality of said recess-tab receiving subassemblies disposed in said lower surface of said header member.

4. A multipurpose container according to claim 1 in which each said header member comprises a pair of spaced vertically aligned key members on each end surface thereof to engage and secure said side portions of said body blank to said header, each of said side portions having a pair of spaced vertically aligned openings adjacent each edge thereof in complementary engaging relationship to said key members on each of said header members.

5. A multipurpose container according to claim 1 in which each header has a pair of spaced opposing hook members disposed upon and integral with said upper surface thereof, each of said hook members having a bevelled surface adapted to engage said tab of a like carton and a planar surface adapted to engage a sidewall of said recess of a like carton whereupon said cartons, when stacked, are prevented from sliding relative to each other in both lateral and longitudinal directions.

6. A multipurpose container according to claim 1 in which each of said top portions has openings defined in substantial registry with a different one of said hook members when said header members are secured in said open ends, said registered openings and hook members coacting to selectively secure one of said top portions to said header members when said selected top portion is folded into substantially normal relationship to the side portion contiguous therewith.

7. A multipurpose container according to claim 3 in which each header has a pair of spaced opposing hook members disposed upon and in integral relationship with said upper surface thereof for cooperative engaging relationship with the recess-tab receiving sub-assemblies of a companion carton juxtaposed therewith for stacking thereupon.

8. A multipurpose container according to claim 2 in which each said header member comprises a pair of spaced vertically aligned key members on each end surface thereof to engage and secure said side portions of said body blank to header, each of said side portions having a pair of spaced vertically aligned openings adjacent each edge thereof in complementary engaging relationship to said key members on each of said header members.

9. A multipurpose container according to claim 4 in which each of said top portions has openings defined in substantial registry with a different one of said hook members when said header members are secured in said open ends, said registered openings and hook members coacting to selectively secure one of said top portions to said header members when said selected top portion is folded into substantially normal relationship to the side portion contiguous therewith.

* * * * *